United States Patent [19]

Ueda et al.

[11] Patent Number: 4,690,575

[45] Date of Patent: Sep. 1, 1987

[54] DEVICE FOR CONTROLLING PRINTING PRESSURE ACCORDING TO THE KIND OF INK RIBBON BEING USED

[75] Inventors: Hiroyuki Ueda, Kawasaki; Yoshihiro Kobata, Tokyo, both of Japan

[73] Assignee: Canon Kabushiki Kaisha, Tokyo, Japan

[21] Appl. No.: 917,312

[22] Filed: Oct. 10, 1986

Related U.S. Application Data

[63] Continuation of Ser. No. 693,236, Jan. 22, 1985, abandoned, Continuation of Ser. No. 462,186, Jan. 31, 1983, abandoned.

[30] Foreign Application Priority Data

Feb. 17, 1982 [JP] Japan ..... 57-25093

[51] Int. Cl.[4] ..... B41J 9/38

[52] U.S. Cl. ..... 400/166; 101/93.03; 400/157.3; 400/227.2

[58] Field of Search ..... 101/93.03; 400/157.2, 400/157.3, 166, 206, 206.1, 210, 247, 227.2

[56] References Cited

U.S. PATENT DOCUMENTS

| | | | |
|---|---|---|---|
| 1,987,276 | 1/1935 | Thompson | 400/210 |
| 3,866,533 | 2/1975 | Gilbert et al. | 101/93.03 X |
| 4,103,617 | 8/1978 | O'Brien et al. | 101/93.03 |
| 4,118,129 | 10/1978 | Grundherr | 400/144.2 |
| 4,217,055 | 8/1980 | Moon | 400/144.2 |
| 4,302,118 | 11/1981 | Schaefer | 400/697.1 |
| 4,334,791 | 6/1982 | Barozzi et al. | 400/166 |
| 4,359,287 | 11/1982 | Asahi | 400/166 |
| 4,403,874 | 9/1983 | Payne et al. | 400/157.3 X |

FOREIGN PATENT DOCUMENTS

| | | | |
|---|---|---|---|
| 2249538 | 5/1975 | France | 101/93.03 |
| 0154193 | 12/1980 | Japan | 400/249 |
| 0129191 | 10/1981 | Japan | 400/249 |
| 2090030 | 6/1982 | United Kingdom | 101/93.03 |

OTHER PUBLICATIONS

IBM Technical Disclosure Bulletin, "Typewriter Print Impression Control" by Anderson et al., vol. 24, No. 8, '82, pp. 4316–4317.

IBM Technical Disclosure Bulletin, "Bold & Multicolored Type" by Brown, vol. 16, No. 3, '73, p. 716.

*Primary Examiner*—Paul T. Sewell

*Attorney, Agent, or Firm*—Fitzpatrick, Cella, Harper & Scinto

[57] ABSTRACT

A printer which operates to use selectively at least two different types of ink ribbons. The printer is characterized in that the printing pressure is varied in response to the selection of the type of ink ribbon.

5 Claims, 1 Drawing Figure

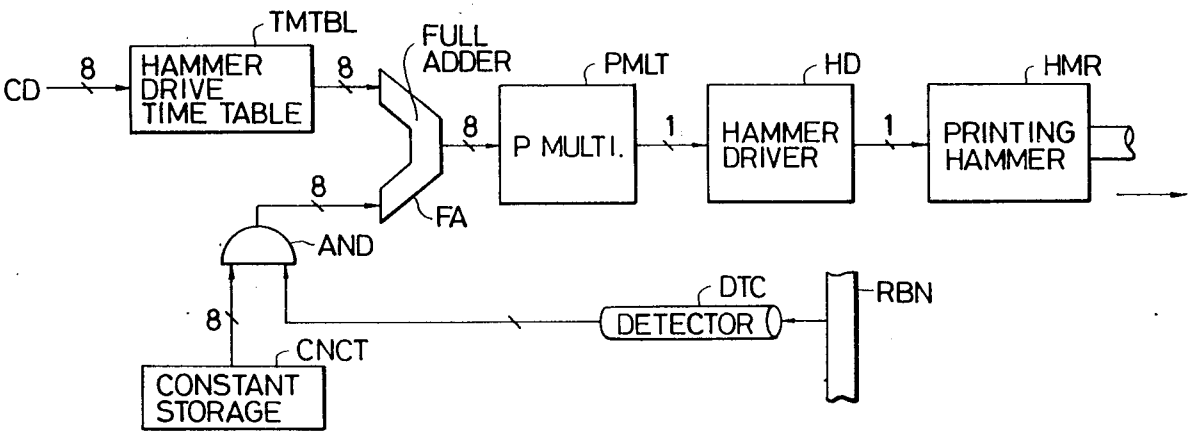
CD
8
TMTBL
HAMMER DRIVE TIME TABLE
8
FULL ADDER
FA
8
PMLT
P MULTI.
1
HD
HAMMER DRIVER
1
HMR
PRINTING HAMMER
8
AND
8
CNCT
CONSTANT STORAGE
8
DTC
DETECTOR
RBN

DEVICE FOR CONTROLLING PRINTING PRESSURE ACCORDING TO THE KIND OF INK RIBBON BEING USED

This application is a continuation of application Ser. No. 693,236, filed 1/22/85, now abandoned, which is a continuation of application Ser. No. 462,186 filed 1/31/83, now abandoned.

BACKGROUND OF THE INVENTION

1. Field of the Invention

The present invention relates to an impact type printer and more specifically to device for controlling the printing pressure with which type is impacted against a recording paper through an ink ribbon. In particular, the present invention is directed to improvement in the quality of print by controlling the printing pressure according to the kind of ink ribbon then used in the printer.

2. Description of the Prior Art

For the impact type printer there are known and used two types of ink ribbons one of which is of multi-strike type and the other is of correctable type. The multi-strike type ink ribbon is adapted for repeated use by being struck many times. To this end, it has a relatively thick ink layer coated on one surface of a substrate at high density. In contrast, the correctable ink ribbon has a relatively thin ink layer so that the ink once printed on the recording paper can be lifted off through an erasing ribbon to correct a printing error.

There are also known those typewriters in which these two different types of ink ribbons can be used selectively and interchangeably. However, the known typewriters have a common important drawback. When the multi-strike type ink ribbon is used, these typewriters can not produce any high quality print. The character printed through the multi-strike ink ribbon is too thick to be legible. Every line of a character or symbol is too heavy and fat. The letters printed by the multi-strike ink ribbon therefore lack sharpness and are poor in print quality.

SUMMARY OF THE INVENTION

Accordingly, the object of the present invention is to overcome the above-mentioned drawbacks involved in the printer according to the prior art.

More specifically, it is the object of the present invention to provide an immproved printer in which the printing pressure is controllable to assure always a high quality of print.

Other and further objects, features and advantages of the invention will appear more fully from the following description taken in connection with the accompanying drawing.

BRIEF DESCRIPTION OF THE DRAWING

The single FIGURE in the accompanying drawing diagrammatically illustrates an embodiment of the present invention.

DESCRIPTION OF THE PREFERRED EMBODIMENT

Referring to the drawing showing an embodiment of the invention, TMTBL is a hammer drive time table, PMLT is a programmable mono-stable multivibrator or timer, HD is a hammer driver, HMR is a printing hammer, FA is a full adder, AND is an eight gate AND-gate, CNCT is an 8-bit constant storage, DTC is a detector for discriminating the type of ink ribbon now being used and RBN is an ink ribbon.

When a character code is applied to the hammer drive time table TMTBL, there is generated an output which is a time constant corresponding to the character. The output time constant is applied to one of the inputs of the full adder FA. Applied to another input of the full adder FA is an output from the AND-gate. The ribbon detector DTC is so formed that when it detects a multi-strike type ink ribbon the detector generates a logic 1 and when it detects a correctable type ink ribbon, the detector generates a logic 0. Therefore, in case the ink ribbon now on the printer is of the multi-strike type, the content of the constant storage CNCT is applied to the full adder FA since the gate AND is opened in this case.

As the content of the constant storage CNCT there are stored such constants which set a shorter hammer drive time for the multi-strike type ink ribbon than that for the correctable type ink ribbon. In other words there are stored in the constant storage CNCT two correction values as determined based on the difference between the hammer drive or operation time for multi-strike type ink ribbon and the hammer drive time for correctable type ink ribbon. Consequently, the full adder FA can generate, as its output, the result of the substraction, the adder FA thus comprising arithmetic operation or processing means. In response to the output from the full adder FA, when the ink ribbon mounted on the printer is of the multi-strike type, the hammer drive time is shortened as compared to the hammer drive time for the correctable type. With the reduction of hammer drive time, the printing pressure is reduced accordingly, thereby attaining good quality printing even for the multi-strike type ink ribbon.

In case the ink ribbon on the printer is of the correctable type, the gate AND is closed. Therefore, in this case, the printing pressure is determined solely by the output from the hammer drive time TMTBL itself and good quality printing is assured also in this case.

As readily understood from the foregoing, the present invention always obtains good quality print no matter what the type of ink ribbon in the printer. Not only for correctable type ink ribbon but also for multi-strike type ink ribbon the printer can produce equally high quality prints.

While the invention has been particularly shown and described with reference to an embodiment in which two different types of ink ribbons are selectively used and the subtrahend is fixed to a value as a constant, it is to be understood that the present invention is applicable also to such a printer in which three or more different types of ink ribbons are selectively used. In this case, two or more constants are stored in the constant storage to individually control the printing pressures for the different types of ink ribbons. Thereby an enhanced effect of the present invention may be obtained.

We claim:

1. A printing device capable of printing with two types of ink ribbon, one of which is usable a plurality of times and the other of which is usable only once, said device comprising:

print pressure information generating means responsive to a code representing a character to be printed for generating print pressure information that varies depending on the character;

means for identifying the type of ink ribbon to be used for printing to determine whether the ink ribbon is usable a plurality of times or usable once;

means for performing an arithemtic operation on said print pressure information, in accordance with the identification of the type of ink ribbon to be used for printing, to produce an arithmetic operation result; and print pressure providing means for providing a print pressure for printing the character in accordance with the arithmetic operation result.

2. A printing device according to claim 1, wherein said print pressure providing means includes a programmable timer and the arithmetic operation result is provided to said programmable timer for generating a signal representing the print pressure in accordance with the arithemtic operation result.

3. A printing device according to claim 1, wherein said print pressure information generating means includes a table memory for storing a plurality of print pressure data.

4. A printing device capable of printing with two types of ink ribbon, one of which is usable a plurality of times and the other of which is usable only once, said device comprising:

memory means for storing a code representing a character to be printed and print drive time information representing the print pressure for printing a corresponding character;

means for identifying the type of ink ribbon as one usable a plurality of times or usable once for printing;

generating means responsive to the identification of the type of ink ribbon for generating print pressure adjusting information;

means for arithmetically processing the print drive time information stored in said memory means and the print pressure adjusting information generated by said generating means; and print pressure providing means for providing a print pressure for printing the character in accordance with the arithmetic processing.

5. A printing device comprising according to claim 4, wherein said print pressure providing means includes a programmable timer.

* * * * *